US005158368A

United States Patent [19]

Lichtwardt et al.

[11] Patent Number: 5,158,368

[45] Date of Patent: Oct. 27, 1992

[54] HANDLE BAG

[75] Inventors: Harlow E. Lichtwardt, Charlotte; Donny B. Prevo, Greensboro, both of N.C.

[73] Assignee: Rexham Corporation, N.C.

[21] Appl. No.: 843,627

[22] Filed: Feb. 28, 1992

[51] Int. Cl.[5] ..... B65D 33/08; B65D 33/10

[52] U.S. Cl. ..... 383/21; 383/10; 493/226

[58] Field of Search ..... 383/21, 29, 10; 493/226

[56] References Cited

U.S. PATENT DOCUMENTS

| | | | |
|---|---|---|---|
| 3,370,630 | 2/1968 | Haugh et al. | 383/21 |
| 4,539,705 | 9/1985 | Baines | 493/226 |
| 4,573,203 | 2/1986 | Peppiatt | 383/29 |
| 4,713,839 | 12/1987 | Peppiatt | 383/29 |
| 4,854,733 | 8/1989 | Schwinn | 383/29 |
| 4,867,575 | 9/1989 | Wood | 383/21 |
| 5,059,034 | 10/1991 | Schulz et al. | 383/21 |

*Primary Examiner*—Stephen P. Garbe

*Attorney, Agent, or Firm*—Schweitzer Cornman & Gross

[57] ABSTRACT

A cubic bag structure provided with a "wrap-around" handle panel construction which is sealed entirely about the periphery of the upper portion of the cubic bag in its squared and filled condition. The handle panel is heat sealed to the outer portion of the front and rear panels of the bag along the upper edges thereof and includes an intermediate portion which is juxtaposed in nesting relation with the top gusset of the bag. In the handle, panel adjacent the front and rear wall panels at the upper edges thereof, a pair of symmetrical oval hand holes are formed. The handle panel may be grasped and distended through the holes to enable a consumer to carry the filled cubic bag. The strap or carrying handle of the new bag includes a tucked-in portion sealed to the side walls of the filled bag in the area of the folded and tucked gusset, as well as in the area of the front and rear panels, thereby providing a distribution of stress completely around the upper portions of the bag when it is lifted.

3 Claims, 2 Drawing Sheets

HANDLE BAG

BACKGROUND OF THE INVENTION

The present invention is directed to plastic bags which are adapted to be filled from open bottoms and sealed. The completed, sealed bag is generally "cubic" or hexahedral in configuration when filled and typically has a handle or a strap integrated into the bag construction to enable the bag to be readily lifted and transported. Specifically, it is to an improvement in the handle construction for such a bag to which the present invention is directed.

Representative of the well-developed state of this art is U.S. Pat. No. 4,573,203 to Peppiatt which discloses a wrap-around handle adhered to peripheral portions which circumscribe the top gusset of the filled bag. A strap handle extending lengthwise of the top gusset, rather than transversely of the gusset, as in Peppiatt, is disclosed in Baines U.S. Pat. No. 4,539,705. A cubic bag having a superimposed strap handle portion overlying the top gusset of a cubic bag and having special D-shaped hand openings is disclosed in Wood U.S. Pat. No. 4,867,575.

SUMMARY OF THE PRESENT INVENTION

The cubic bag of the present invention is formed from a bottom loaded, top gussetted plastic bag, which when filled with goods such as disposable infant diapers or adult disposable briefs, approximates the hexahedral or "cubic" shape of a paperboard carton. More particularly, the bag of the present invention is formed from a folded plastic film which has front and rear panels overlying one another, which panels are sealed along a vertical seal line disposed between adjacent bags when the bags are formed in a continuous manner. The eventual top wall of the completed bag is formed from an integral top gusset which is folded between the facing front and rear panels and is articulated to the upper edges thereof.

In accordance with the present invention, the new and improved bag structure is provided with a "wrap-around" handle panel construction which is sealed entirely about the periphery of the upper portion of the cubic bag in its squared and filled condition. Specifically the handle panel is heat sealed to the outer portion of the front and rear panels of the bag along the upper edges thereof and includes an intermediate portion which is juxtaposed in nesting relation with the top gusset of the bag. In the handle panel, adjacent the front and rear wall panels at the upper edges thereof, a pair of symmetrical oval hand holes are formed. The handle panel may be grasped and distended through the holes to enable a consumer to carry the cubic bag. In accordance with an important principle of the present invention, the strap or carrying handle of the new bag includes a tucked-in portion sealed to the bag in the area of the folded and tucked gusset, as well as in the area of the front and rear panels, thereby providing a distribution of stress completely around the upper portions of the bag when it is lifted.

For a more complete understanding of the principles of the present invention and a better appreciation of other of its attendant advantages, reference should be made to the following detailed description of the invention taken in conjunction with the accompanying drawings.

DETAILED DESCRIPTION OF THE INVENTION

Figure 1:
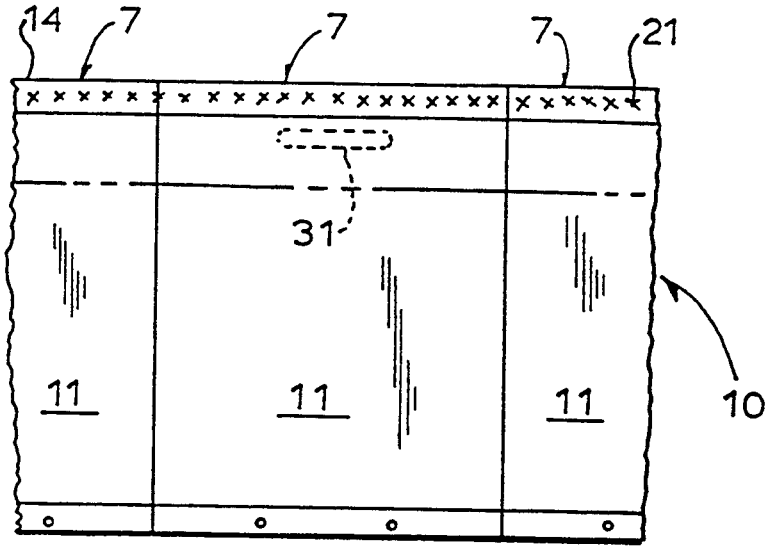
FIG. 1 is a plan view of a chain of plastic bags made in accordance with the principles of the invention.
Figure 2:
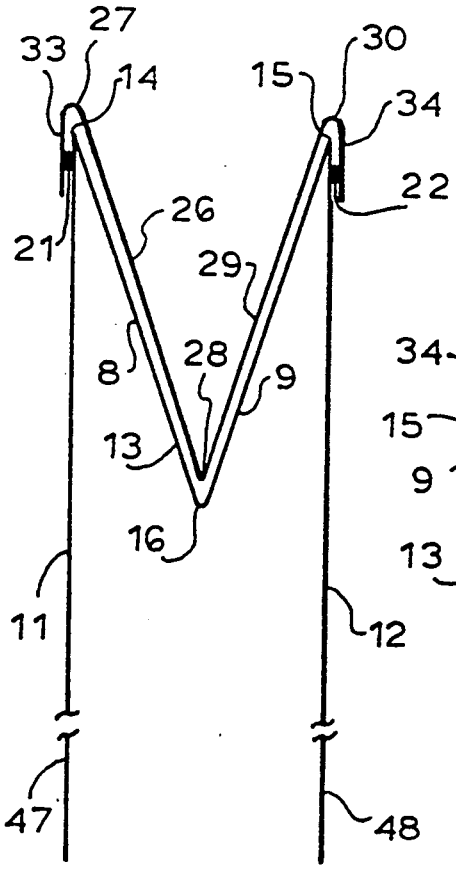
FIG. 2 is an enlarged schematic cross-sectional view of the upper portion of the new bag showing the relationship of the handle portion to the remainder of the bag.
Figure 3:
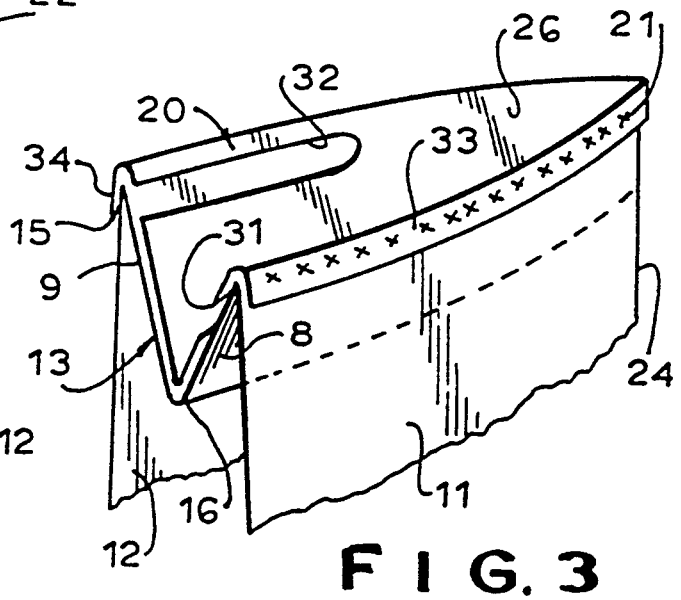
FIG. 3 is a perspective view showing the relationship of the wrap-around handle to the upper edges of the bag.

Referring now to FIGS. 1 and 2, the new and improved plastic bags 7 of the present invention are formed in a continuous chain by folding a film of material 10 over itself so as to have a generally V-shaped top-forming gusset panel 13 between front panels 11 and rear panels 12, with the V-shaped gusset 13 having top wall panels 8, 9 articulated to the front panels 11 and rear panels 12 along fold lines 14, 15, respectively at the upper edges thereof. The V-shaped gusset panel 13 includes a central fold line 16 at its midpoint which lies along the central axis of the cubic bag when it is filled.

In accordance with the principles of the invention, a handle panel 20 is heat welded completely across the front and rear panels 11, 12 respectively along horizontal weld lines 21, 22. As shown, the welds 21, 22 extend horizontally between vertical side welds 23, 24 which connect the front panels to the rear panels in the flat folded condition as will be understood. Thus when the bag of the invention is erected into a cubic form, as to be described hereinafter, the handle panel 20 will be securely attached to the top edges of the cubic bag by a circumscribing weld comprised of the two welds 21, 22. In particular, the handle panel 20 includes a flange portion 33 which overlies the front panel 11 and flange portion 34 which overlies the rear panel 12. The handle panel 20 itself is gussetted and is superimposed over the top-forming gusset 13 as shown. More specifically, there is a first folded handle portion 26 which extends from the top of the flange 33 at a fold line 27 to a central fold line 28 (collinear with the fold line 16) while a second handle panel portion 29 extends downwardly from the top of the flange 34 at a fold line 30 down to the fold line 28. In accordance with the principles of the invention, an oval hand slot 31 is formed in the portion 26 while an identical slot 32 is formed in the portion 29, as shown best in FIG. 4.

Figure 4:
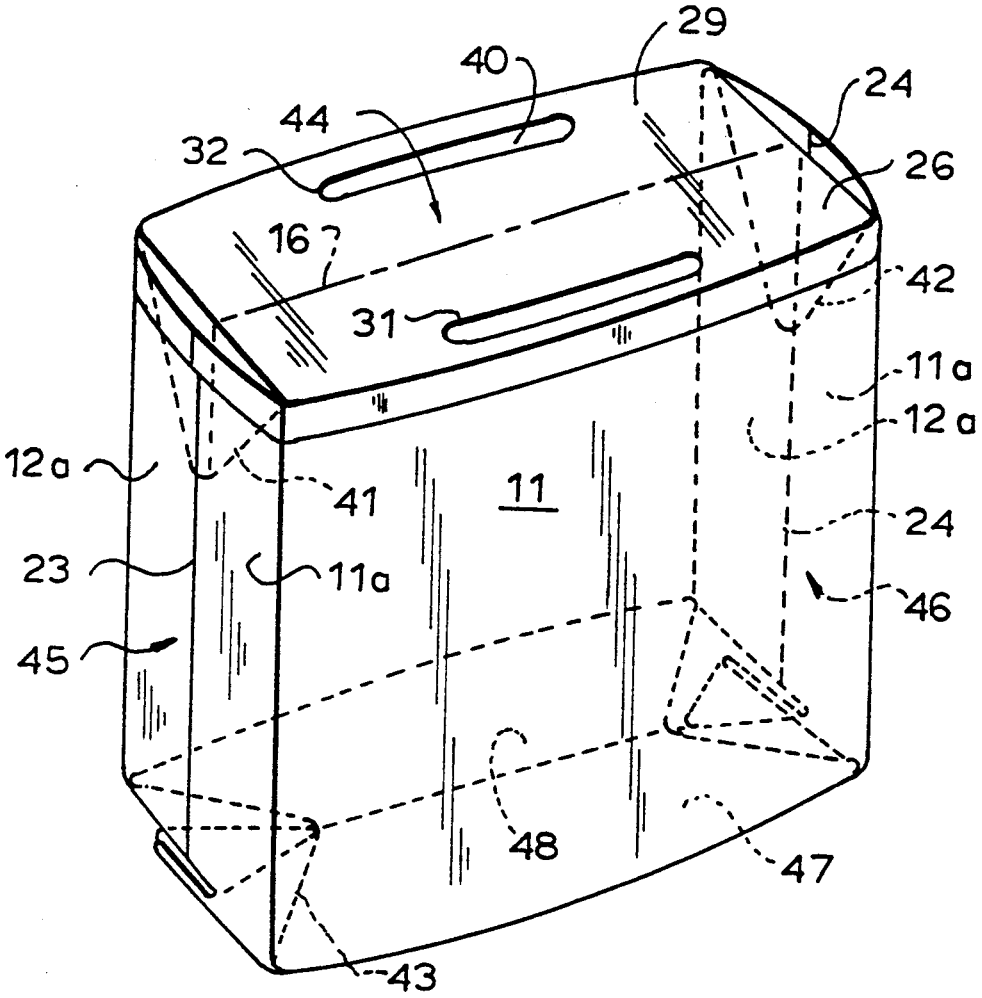
FIG. 4 is a perspective view showing a squared and filled bag embodying the principles of the invention.

In use, the chain of cubic bags is divided to separate the bags 7 one from the other along the axes of the vertical weld lines 23, 24. The individual bags are closed at the top and are adapted to be filled from the opened bottom portion as follows. The bags 7 are inverted and squared in a manner whereby top-gusset panel 13 and the overlying handle panel 20 are opened up and flattened into a horizontal plane so as to form a top wall with a superimposed handle for the package. In doing so, the opposite lateral border portions 11*a*, 12*a* of the front and rear panels 11, 12 combine to form opposite, parallel end walls with the vertical heat seals 23, 24 being the centerlines thereof as shown in FIG. 4. In the squaring of the bag the end portions of the top-forming gusset panel 13, as well as the end portions of the handle panel 20, are folded downwardly and inwardly into triangular portions 41, 42 which are tucked-in and disposed in a flattened form against the inner surfaces of the end walls 45, 46 of the cubic bag formed by the side portions 11*a*, 12*a*. It will be appreciated that the welds 21, 22 securing the handle panel 20 to the front and rear panels 11, 12 completely circumscribes the upper wall 40 of the squared bag in its filled condition. It is to be understood of course that when the bag is being filled the top wall 40 is inverted so that the contents of the bag may be readily inserted. Once the bag is filled the bottom edges 47, 48 of the front and rear walls 11 and 12 are infolded and sealed, typically utilizing a triangular infolded portion 43, as shown in FIG. 4, to obtain a neatly sealed and flat-bottomed package.

Figure 5:
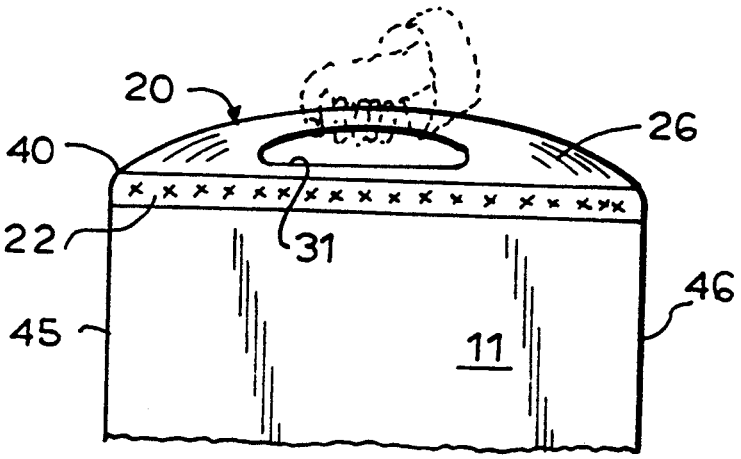
FIG. 5 is a front elevational view showing the handle of the new bag in use.

Referring now to FIG. 5, in use a consumer need only slide a hand through the slots holes 31, 32 to form and distend a domed carrying strap 44 which is formed by the central portions 26, 29 of the handle panel lying between the openings 31, 32. It will be appreciated that the domed strap 44 is attached to the upper edges of the cubic bag by the circumscribing seals 21, 22 and therefore the stress of lifting the loaded cubic bag will be well distributed about the top of the completed package by the plastic material of the handle panel 20 interposed between the slots 31, 32 and the top edges of the bag. The stress distribution at the ends of the bag is accommodated in large measure by the two plies of the infolded triangular portions 41, 42 of the top-forming gusset panel 13 of the bag as well as the superimposed tucked-in end portions of the handle panel 20.

While the present invention has been described with reference to a particular preferred embodiment, it will be appreciated that certain variations and modifications can be made by those skilled in the art. Accordingly, the invention is to be limited only as set forth in the appended claims.

We claim:

1. In a plastic bag comprising a web of thermoplastic material folded laterally on itself to form front and rear panels and a top gusset panel between the front and rear panels at the top of the bag, said front and rear panels having parallel side edges, and said top gusset panel having end edges colinear with and positioned between upper portions of the side edges of the front and rear panels when the bag is flat and unfilled; and side seals welding the side edges of the front and rear panels, and further connecting the end edges of the top gusset panel together and to the upper portions of the side edges of the front and rear panels, in a manner accommodating the formation of the bag into a six-sided cubic shape with front, rear, top, bottom, and two side walls, and the gusset panel being substantially flat and forming the closed top wall for the bag when it is filled; an improved wrap-around handle construction including (a) a gusset-like handle panel web of thermoplastic material having opposite lateral and end edge portions and a central portion between said edge portions, overlying the top gusset panel, and lateral and end welds connecting the lateral and end edge portions of the handle panel to the front and rear panels of the bag web adjacent the top gusset panel, said central portion including a pair of spaced elongated hand slots;

(b) said hand slots being symmetrically arranged in the central portion of the handle panel;

(c) said handle panel defining a distendable four-sided elongated strap handle located between the slots and extending longitudinally of the top gusset panel to both the front and rear walls and the two side walls of the bag and;

(d) opposite ends of the strap handle extending endwise beyond the edges of the top of the bag and being tucked in and below the top of the bag along with the ends of the top gusset panel at the two side walls of the bag, when the bag is filled.

2. The bag of claim 1, in which (a) said elongated hand slots are elliptical in shape.

3. The bag of claim 1, in which (a) said elongated slots are generally parallel to one another and to the central axis of the top of the bag when cubed and filled.

* * * * *